US007090540B2

(12) United States Patent
Masumoto et al.

(10) Patent No.: US 7,090,540 B2
(45) Date of Patent: Aug. 15, 2006

(54) CONNECTOR IN WHICH TERMINAL PORTIONS CAN EASILY BE ARRANGED AT A LARGE PITCH

(75) Inventors: Toshio Masumoto, Tokyo (JP); Yuichi Saito, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/101,092

(22) Filed: Apr. 7, 2005

(65) Prior Publication Data

US 2005/0227543 A1 Oct. 13, 2005

(30) Foreign Application Priority Data

Apr. 9, 2004 (JP) ..... 2004-115665

(51) Int. Cl.
*H01R 24/00* (2006.01)

(52) U.S. Cl. ..... 439/660; 439/108

(58) Field of Classification Search ..... 439/607, 439/660, 74, 78, 567
See application file for complete search history.

(56) References Cited

U.S. PATENT DOCUMENTS 4,734,060 A * 3/1988 Kawawada et al. ..... 439/660
6,241,556 B1 * 6/2001 Chih ..... 439/607
6,371,771 B1 * 4/2002 Fan ..... 439/79
6,447,340 B1 * 9/2002 Wu ..... 439/660

FOREIGN PATENT DOCUMENTS

JP 8-162187 A 6/1996
JP 2002-151187 A 5/2002
JP 2002-334748 A 11/2002

* cited by examiner

*Primary Examiner*—Gary P. Paumen
*Assistant Examiner*—Larisa Tsukerman
(74) *Attorney, Agent, or Firm*—Frishauf, Holtz, Goodman & Chick, P.C.

(57) ABSTRACT

A plurality of contact members are held by an insulator in two rows. The contact members include first contacts and second contacts in each of the two rows. Each of the first and the second contacts has a contacting portion to be connected to a mating contact and a terminal portion to be connected to a connection object. The terminal portions of the first contacts are collectively arranged in a predetermined row. The second contacts in one and the other of the two rows are inverted in position from each other. The terminal portions of the second contacts in one and the other of the two rows are arranged on one and the other sides of the predetermined row, respectively.

14 Claims, 6 Drawing Sheets

CONNECTOR IN WHICH TERMINAL PORTIONS CAN EASILY BE ARRANGED AT A LARGE PITCH

This application claims priority to prior Japanese patent application JP 2004-115665, the disclosure of which is incorporated herein by reference.

BACKGROUND OF THE INVENTION

This invention relates to a connector comprising a plurality of contact members and, in particular, to a connector in which contacting portions and terminal portions of contacts are different in arrangement from each other.

A typical connector comprises an insulator and a plurality of contact members held by the insulator. Each of the contact members has a contacting portion to be connected to a mating contact and a terminal portion to be connected to a board as a connection object. The terminal portion is connected to the board, for example, by soldering the terminal portion to the board or by inserting the terminal portion into a through hole formed in the board. In this connection, the terminal portions are desired to have a large pitch as compared with the contacting portions.

Various techniques for pitch conversion of the terminal portions of the contacts are disclosed, for example, in Japanese Unexamined Patent Application Publications (JP-A) Nos. H8-162187, 2002-151187, and 2002-334748. These techniques are effective in a connector in which contacting portions of contacts are arranged in a grid-like pattern. However, in case where the contacting portions are arranged in two rows and shifted by a half pitch between the two rows, i.e., in case where the contacting portions are arranged in a staggered pattern, no merit is achieved by these techniques.

SUMMARY OF THE INVENTION

It is therefore an object of this invention to provide a connector in which terminal portions can easily be arranged at a large pitch even if contacting portions are arranged in a staggered pattern.

It is another object of this invention to achieve the above-mentioned object by the use of two kinds of contacts.

Other objects of the present invention will become clear as the description proceeds.

According to an aspect of the present invention, there is provided a connector comprising an insulator and a plurality of contact members held by the insulator in two rows; the contact members including first contacts and second contacts in each of the two rows; each of the first and the second contacts having a contacting portion to be connected to a mating contact and a terminal portion to be connected to a connection object; the terminal portions of the first contacts being collectively arranged in a predetermined row; the second contacts arranged in one and the other of the two rows being inverted in position from each other; the terminal portions of the second contacts in one of the two rows being arranged on one side of the predetermined row; the terminal portions of the second contacts in the other of the two rows being arranged on the other side of the predetermined row.

According to another aspect of the present invention, there is provided a connector comprising a plurality of contact members having, at opposite ends thereof, contacting portions and terminal portions, respectively, the contacting portions being arranged in two rows at both sides of a plane, the terminal portions being arranged in three rows, one of the three rows being on the plane, the remaining two of the three rows at both sides of the plane.

DESCRIPTION OF THE PREFERRED EMBODIMENT

Referring to FIGS. 1 to 6, a connector according to an embodiment of this invention will be described.

The connector 10 illustrated in the figures is a receptacle connector and comprises an insulator 11 and a plurality of conductive contact members held by the insulator 11. The contact members include first contacts 13 and second contacts 14.

Each of the first contacts 13 has a contacting portion 13*a* to be connected to a mating contact of a mating connector (not shown), a terminal portion 13*b* to be connected to a board as a connection object mounted to an apparatus (not shown), and a holding portion 13*c* interposed between the contacting portion 13*a* and the terminal portion 13*b* and adapted to be press-fitted to the insulator 11. Each of the terminal portions 13*b* and 14*b* is connected to the board via a through hole formed in the board, for example, by soldering.

Figure 6:
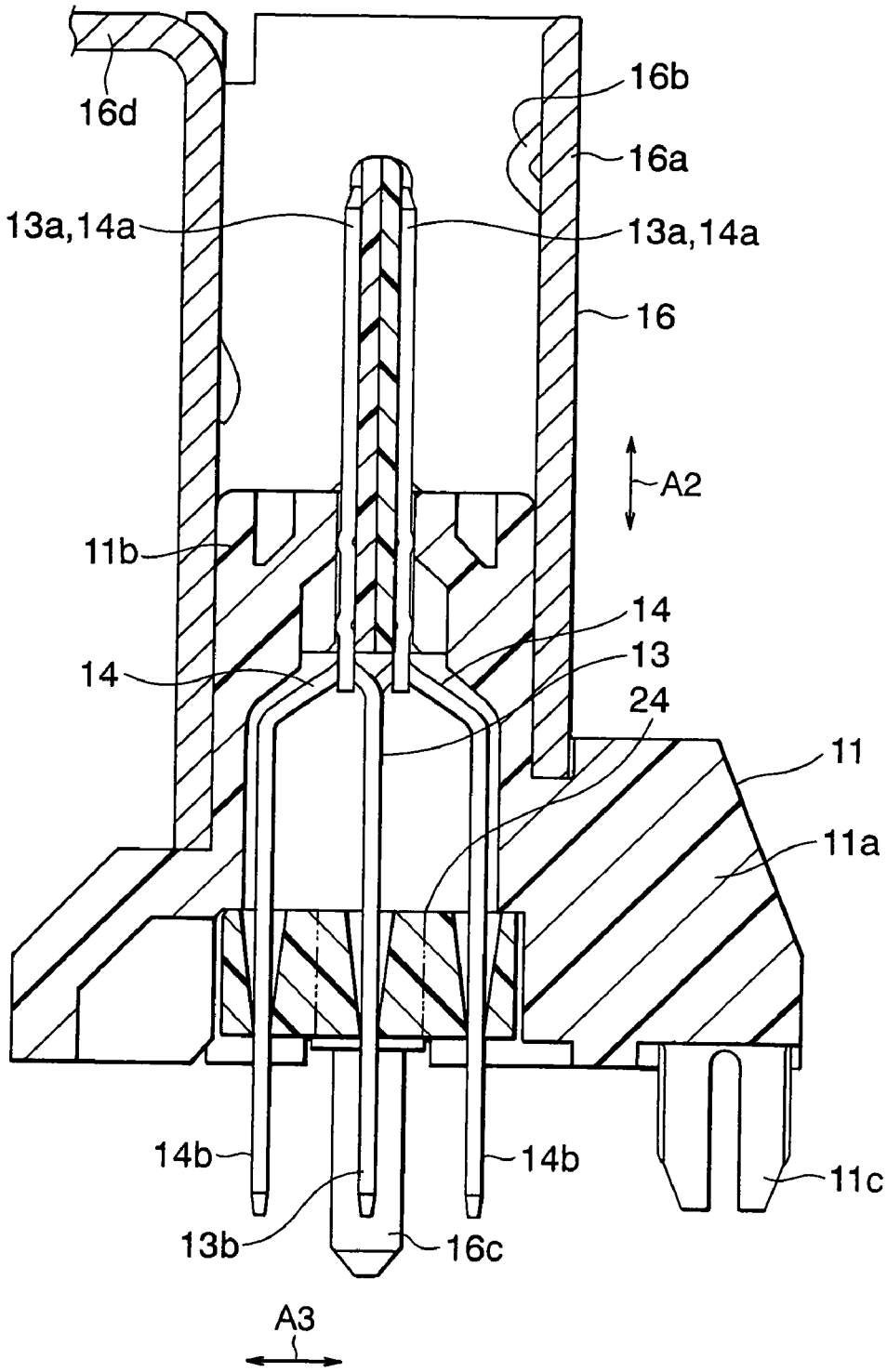
FIG. 6 is an enlarged vertical sectional view of the connector illustrated in FIG. 1.

The contact members are arranged in two rows, i.e., a first and a second row each of which extends a horizontal first direction A1. Each of the first and the second rows contains a plurality of the first contacts 13 and a plurality of the second contacts 14. As shown in FIG. 6, each of the first and the second contacts 13 and 14 extends generally in a vertical direction, i.e., a second direction A2.

Figure 1:
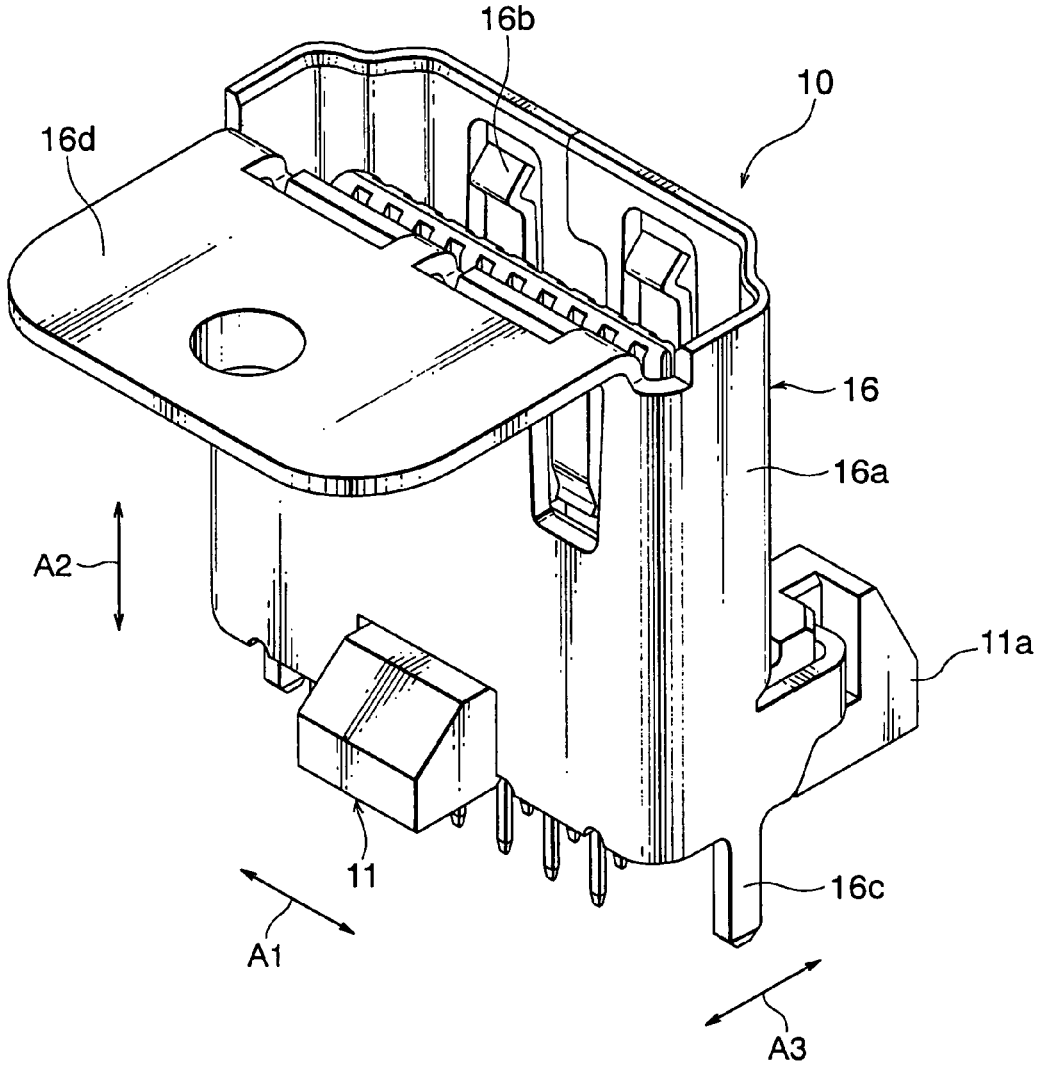
FIG. 1 is a perspective view of a connector according to an embodiment of this invention.
Figure 2:
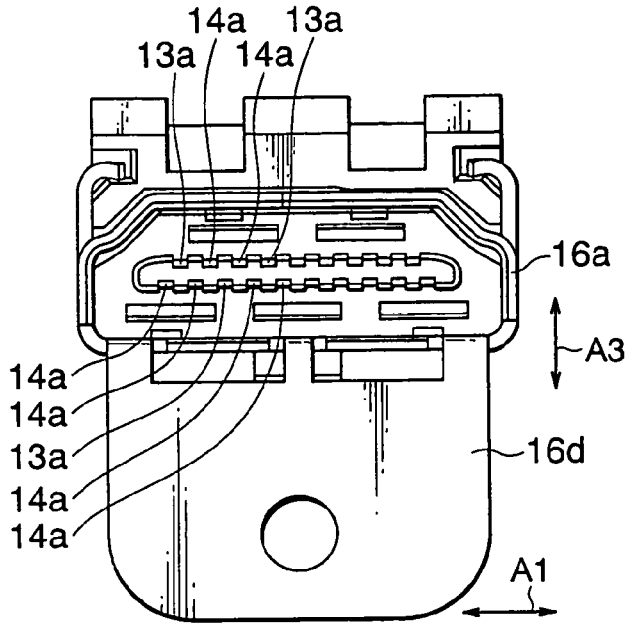
FIG. 2 is a top plan view of the connector illustrated in FIG. 1.
Figure 3:
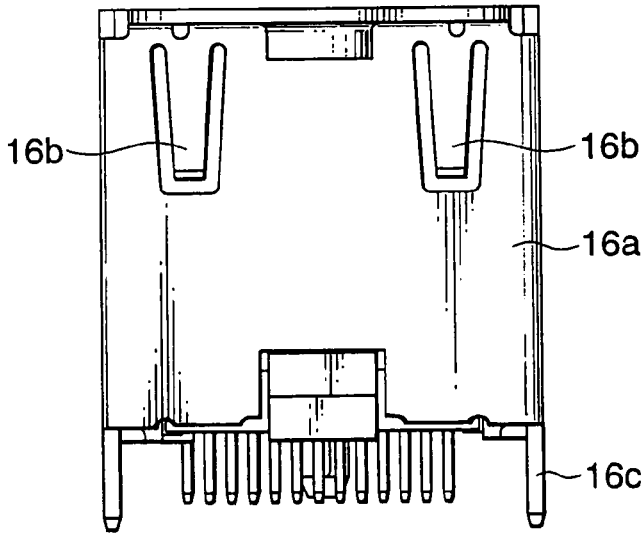
FIG. 3 is a front view of the connector illustrated in FIG. 1.
Figure 4:
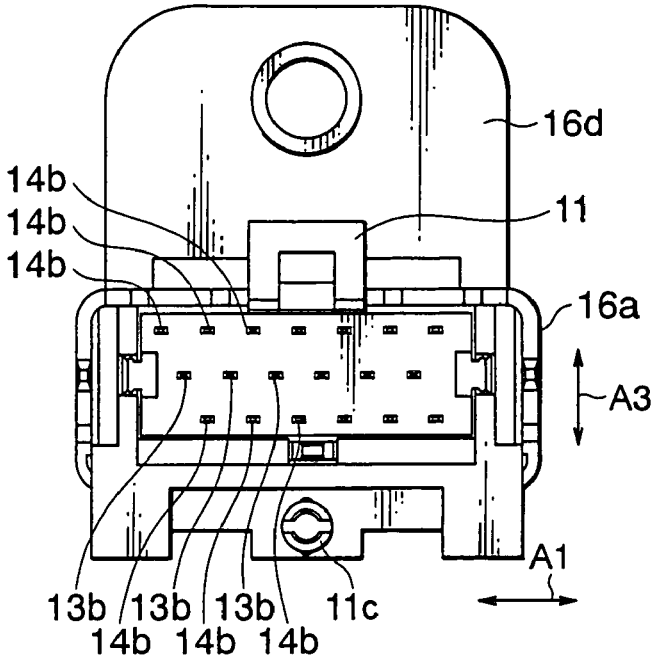
FIG. 4 is a bottom plan view of the connector illustrated in FIG. 1.
Figure 5:
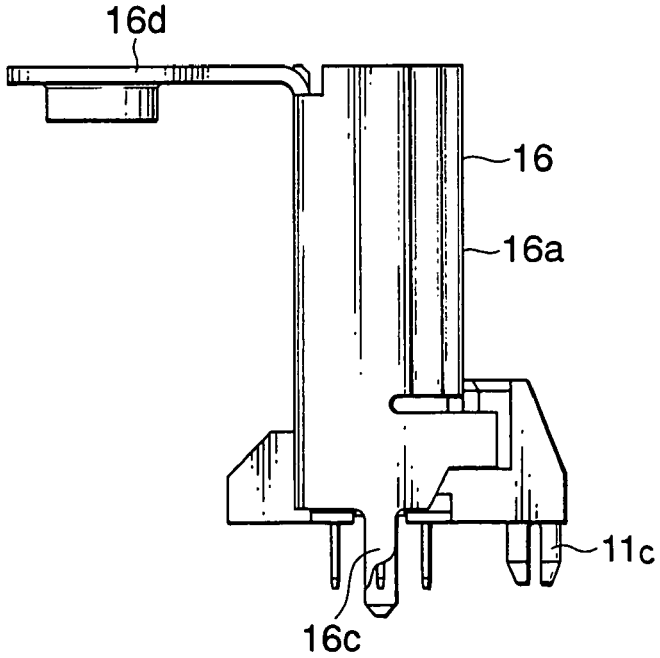
FIG. 5 is a side view of the connector illustrated in FIG. 1.

As shown in a bottom plan view in FIG. 4, the terminal portions 13*b* and 14*b* of the first and the second contacts 13 and 14 are arranged in three rows extending in the first direction A1. Specifically, the terminal portions 13*b* of the first contacts 13 are collectively arranged in a predetermined one of the three rows, i.e., a center row in a horizontal third direction A3 perpendicular to the first and the second directions A1 and A2.

The second contacts 14 in the first row and in the second row are inverted in attitude from each other. As a result, the terminal portions 14*b* of the second contacts 14 in the first row and in the second row are arranged on one side and the other side of the center row, respectively, and spaced from the terminal portions 13*b* in the center row to form peripheral rows.

The contacting portions 13*a* and 14*a* of the contact members (the first and the second contacts 13 and 14) in the first row and in the second row are also arranged in two rows extending in the first direction A1 and spaced from each other. The above-mentioned center row of the terminal portions 13*b* is positioned to correspond to an intermediate position between the two rows of the contacting portions 13*a* and 14*a*. In each of the first and the second rows, every two of the second contacts 14 are adjacent to each other and each of the first contacts 13 is arranged adjacent to every two adjacent ones of the second contacts 14.

The connector 10 further comprises a metal shell 16 surrounding the contacting portions 13*a* and 14*a* with a space kept therefrom. The shell 16 comprises a cylindrical fitting portion 16*a* fixed to the insulator 11, a shell contact spring 16*b* formed near an upper end of the fitting portion 16*a* and protruding inward, a pair of shell terminals 16*c* extending downward from the fitting portion 16*a* and protruding below the insulator 11, and a fixing portion 16*d* extending from the fitting portion 16*a* in the third direction A3 to be fixed to a frame of the apparatus.

The insulator 11 has a base portion 11*a*, a support portion 11*b* integrally formed on one surface or an upper surface of the base portion 11*a*, and a positioning boss 11*c* formed on an opposite surface or a lower surface of the base portion 11*a*. The support portion 11*b* is fitted into the fitting portion 16*a* to be fixed. In this condition, the base portion 11*a* protrudes from the fitting portion 16*a* in a radially outward direction.

The positioning boss 11*c* is inserted into a through hole (not shown) of the board to thereby position the connector 10 with respect to the board. In addition, the terminal portions 13*b* and 14*b* and the shell terminals 16*c* are inserted into through holes of the board. Thus, the connector 10 is electrically connected to the board.

The connector 10 will presently be described by the use of other words. The contacting portions 13*a* and 14*a* are arranged in two rows at both sides of a plane extending in the first and the second directions Al and A2. The terminal portions 13*b* and 14*b* are arranged in three rows. One of the three rows is on the plane. The remaining ones of three rows are at both sides of the plane.

More particularly, the terminal portions 13*b* of the first contacts 13 are collectively arranged on the plane. The contacting portions 13*a* of the first contacts 13 are separated into two groups arranged at both sides of the plane, respectively. The second contacts 14 are separated into two groups arranged at both sides of the plane, respectively. Two of the contacting portions 14*a* of the second contacts 14 are adjacent to each other in the first direction A1 to make a pair at each side of the plane. One of the contacting portions 13*a* of the first contacts 13 is adjacent to the pair at each side of the plane in the first direction A1.

Figure 7:
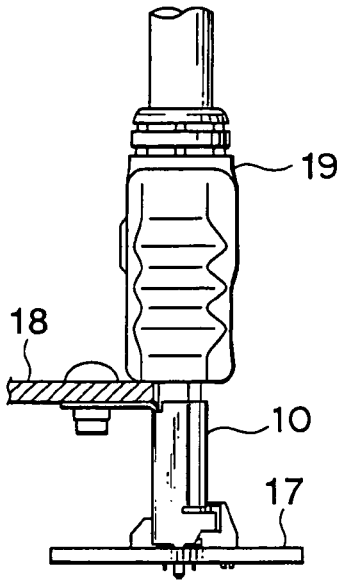
FIG. 7 is a view showing a mounted state of the connector illustrated in FIG. 1.

Referring to FIG. 7, the connector 10 is attached to the board 17 and the frame 18 of the apparatus. A plug connector 19 is connected to the connector 10 that is the receptacle connector.

Figure 8A:
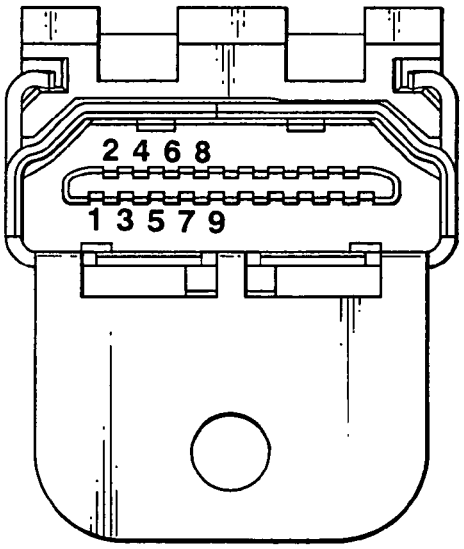
FIG. 8A is a view showing an arrangement of contacting portions in the connector illustrated in FIG. 1.
Figure 8B:
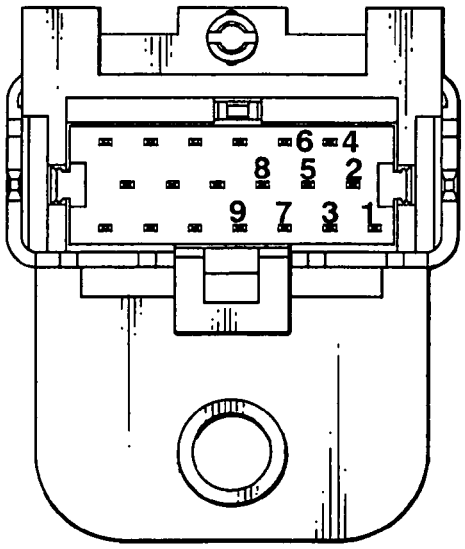
FIG. 8B is a view showing an arrangement of terminal portions in the connector illustrated in FIG. 1.

Referring to FIGS. 8A and 8B, additional description will be made of the relationship between the arrangement of the contacting portions 13*a* and 14*a* and the arrangement of the terminal portions 13*b* and 14*b*.

In FIG. 8A, reference numerals 1 to 9 correspond to the contacting portions of the contacts, respectively. In FIG. 8B, reference numerals 1 to 9 correspond to the terminal portions of the contacts, respectively. Herein, the same reference numerals in FIGS. 8A and 8B represent the same contact.

The contacting portions of the contacts are arranged in a staggered pattern in the first direction A1 as depicted by the reference numerals 1 to 9 in FIG. 8A. On the other hand, the terminal portions of the contacts are arranged in three rows as depicted by the reference numerals 1 to 9 in FIG. 8B.

Figure 9A:
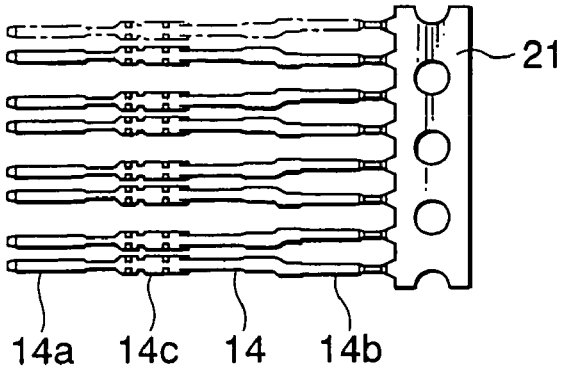
FIGS. 9A to 9C are views for describing first and second contacts in the connector illustrated in FIG. 1.
Figure 9B:
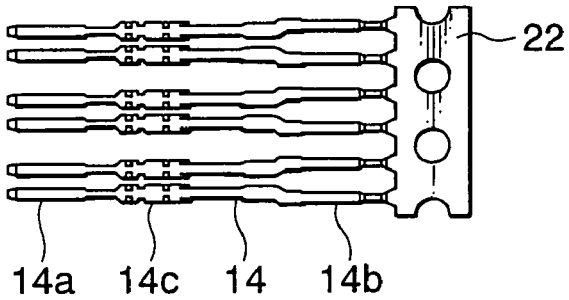
Figure 9C:
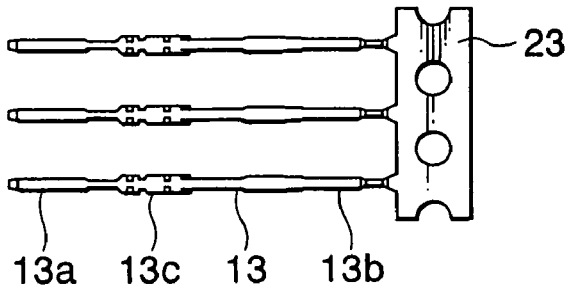

Referring to FIGS. 9A to 9C, additional description will be made of the first and the second contacts 13 and 14.

FIG. 9A shows an intermediary part which may be used in formation of the second contacts 14 in the first row. In the intermediary part, a carrier 21 is integrally formed adjacent to the terminal portions 14*b* of the second contacts 14. Generally, the intermediary part is stored in the state where the carrier 21 is reeled, and is used by cutting the carrier 21 into a predetermined length. Since the carrier 21 is continuously cut by the predetermined length, the number of contacts held by the carrier 21 after cutting may not coincide with a desired number. In such event, an unnecessary contact (depicted by a dash-and-dot line) is cut away.

FIG. 9B shows an intermediary part which may be used in formation of the second contacts 14 in the second row. In the intermediary part, a carrier 22 is integrally formed adjacent to the terminal portions 14*b* of the second contacts 14. Since the second contacts 14 in the first and the second rows are same in shape, the intermediary parts in FIGS. 9A and 9B may be produced by the use of a same die. Therefore, the second contacts 14 in the first and the second rows may be produced from the same intermediary part, i.e., one of the intermediary parts in FIGS. 9A and 9B.

FIG. 9C shows an intermediary part which may be used in formation of the first contacts 13. In the intermediary part, a carrier 23 is integrally formed adjacent to the terminal portions 13*b* of the first contacts 13.

Next, description will be made of assembling of the connector 10 in detail. The intermediary parts in FIGS. 9A to 9C are press-fitted to the insulator 11 with the carriers 21, 22, and 23 retained. Thereafter, the carriers 21, 22, and 23 are removed (broken off or cut away). A part locator 24 for correcting positions of the terminal portions 13*b* and 14*b* is press-fitted to the insulator 11. Further, the shell 16 is fitted to the insulator 11. The order of assembling may be appropriately changed.

In the connector 10 mentioned above, the contacting portions in the fitting portion are arranged in two rows in a staggered pattern while the terminal portions are arranged in three rows. Therefore, even in a small-sized connector, a limited space is effectively used and the terminal portions on the side of the board are arranged at a pitch and a row space sufficiently wide.

Further, by using every two of the second contacts for connection of a signal line and every one of the first contacts for ground connection, a triangular arrangement of a set of the three contacts can be achieved not only on the side of the contacting portions but also on the side of the terminal portions. Accordingly, it is possible to obtain a higher electrical performance.

In the foregoing, the second contacts 14 are inverted in position. Further, the first contacts 13 may be inverted in position, i.e., both of the first and the second contacts may be inverted in position.

While the present invention has thus far been described in connection with a preferred embodiment thereof, it will readily be possible for those skilled in the art to put this invention into practice in various other manners. The connector can be used in a high differential signal transmission system. In this event, each of the first contacts is used as a ground contact while each of the second contacts is used as a signal contact.

What is claimed is:

1. A connector comprising:

an insulator; and a plurality of contact members held by the insulator;

wherein:

the plurality of contact members includes a plurality of first contacts and a plurality of second contacts which are arranged in two rows such that a plurality of the first contacts and a plurality of the second contacts are arranged in each of the two rows;

each of the first and the second contacts has a contacting portion to be connected to a mating contact and a terminal portion to be connected to a connection object;

the terminal portions of the first contacts in both of the two rows are collectively arranged in a same predetermined row;

the second contacts arranged in a first one of the two rows are inverted in position with respect to the second contacts arranged in a second one of the two rows;

the terminal portions of the second contacts in the first one of the two rows are arranged on a first side of the predetermined row; and the terminal portions of the second contacts in the second one of the two rows are arranged on a second side of the predetermined row.

2. The connector according to claim 1, wherein the contacting portions of the first and the second contacts are arranged the two rows which are spaced apart from each other.

3. The connector according to claim 2, wherein the predetermined row in which the terminal portions of the first contact are arranged is positioned to correspond to an intermediate position between the two rows of the contacting portions.

4. The connector according to claim 1, wherein, in each of the two rows, the second contacts are arranged in pairs in which two of the second contacts are adjacent to each other, and each of the first contacts is arranged between pairs of the second contacts.

5. The connector according to claim 1, further comprising a metal shell surrounding the contacting portions and spaced apart therefrom.

6. The connector according to claim 5, wherein the shell includes a cylindrical fitting portion fixed to the insulator.

7. The connector according to claim 6, wherein the insulator comprises a base portion, a support portion integrally formed on one surface of the base portion, and a positioning boss formed on an opposite surface of the base portion, and wherein the support portion of the insulator is fitted to a first end of the fitting portion of the metal shell.

8. The connector according to claim 7, wherein the base portion protrudes radially outward from the fitting portion.

9. The connector according to claim 7, wherein the shell further comprises a shell contact spring which protrudes into the shell and is formed at a second end of the fitting portion that is opposite to the first end.

10. The connector according to claim 7, wherein the shell further comprises a pair of shell terminals extending from the fitting portion beyond the insulator.

11. The connector according to claim 7, wherein the shell further comprises a fixing portion extending from a second end of the fitting portion that is opposite to the first end.

12. A connector comprising:

a plurality of contact members having contacting portions and terminal portions at opposite ends thereof;

wherein the contacting portions are arranged in two rows on respective opposite sides of a plane, such that the contacting portions in the two rows forms a staggered pattern;

wherein the terminal portions are arranged only in three rows, one of which is on the plane, and two of which are provided on respective opposite sides of the plane;

wherein the terminal portions on a first one of the sides of the plane directly oppose the terminal portions on a second one of the sides of the plane in a one-to-one correspondence, the terminal portions on the first side of the plane are in a staggered relationship with the terminal portions in the row on the plane, and the terminal portions on the second side of the plane are in a staggered relationship with the terminal portions in the row on the plane.

13. The connector according to claim 12, wherein the contact members comprise first contacts and second contacts, the terminal portions of the first contacts are collectively arranged in the one of the three rows that is on the plane, the contacting portions of the first contacts are separated into two groups arranged in the two rows on respective opposite sides of the plane, and the second contacts are separated into a first group in which the terminal portion of the contacts are provided on the first side of the plane and a second group in which the terminal portions of the contacts are provided on the second side of the plane.

14. The connector according to claim 13, wherein the contacting portions of the first group of second contacts and the contacting portions of the second group of second contacts are arranged in respective ones of the two rows of contacting portions, and in each of the two rows, the second contacts are arranged in pairs in which two of the second contacts are adjacent to each other, and each of the first contacts is arranged between pairs of the second contacts.

* * * * *